US008323154B1

(12) United States Patent
Bolillo

(10) Patent No.: US 8,323,154 B1
(45) Date of Patent: Dec. 4, 2012

(54) TRAMPOLINE ENTERTAINMENT SYSTEMS AND METHODS THEREOF

(76) Inventor: Mathieu Anthony Bolillo, Las Vegas, NV (US)

( * ) Notice: Subject to any disclaimer, the term of this patent is extended or adjusted under 35 U.S.C. 154(b) by 26 days.

(21) Appl. No.: 12/168,102

(22) Filed: Jul. 4, 2008

Related U.S. Application Data

(60) Provisional application No. 60/947,988, filed on Jul. 5, 2007.

(51) Int. Cl.
*A63B 21/00* (2006.01)

(52) U.S. Cl. ..... 482/27; 482/28

(58) Field of Classification Search ..... 482/27–28; 52/182
See application file for complete search history.

(56) References Cited

U.S. PATENT DOCUMENTS 2,097,273 A * 10/1937 Feist ..... 482/52
3,233,895 A * 2/1966 Grelle et al. ..... 482/27
3,310,305 A * 3/1967 Howe ..... 482/29
5,512,026 A * 4/1996 Wilkinson ..... 482/52
5,533,948 A * 7/1996 Wilkinson ..... 482/27
5,645,510 A * 7/1997 Wilkinson ..... 482/27
6,926,643 B1 * 8/2005 Gvoich ..... 482/52
2002/0137598 A1 * 9/2002 Publicover et al. ..... 482/27
2006/0272230 A1 * 12/2006 Elwood ..... 52/182

FOREIGN PATENT DOCUMENTS

JP 2003126289 A * 5/2003

* cited by examiner

*Primary Examiner* — Jerome W Donnelly
(74) *Attorney, Agent, or Firm* — Connie R. Masters

(57) ABSTRACT

Trampoline systems are disclosed. The trampoline systems comprise one or more step assemblies. The step assemblies have one or more flight of steps and include one or more sides. The step assemblies may have one or more landing surfaces. One or more trampolines may be located peripherally about the one or more sides of the step assemblies. The trampolines each have at least one rebound top surface. The trampoline systems provide a landing and rebalancing opportunity from the step assemblies onto the rebound top surfaces of the trampolines. Methods of using the trampoline systems are disclosed.

11 Claims, 4 Drawing Sheets

TRAMPOLINE ENTERTAINMENT SYSTEMS AND METHODS THEREOF

CROSS-REFERENCE TO RELATED APPLICATION

This application Claims the Priority Date of U.S. Provisional Application No. 60/947,988, filed Jul. 5, 2007 with the same title as shown herein and in the name of the same discloser.

FIELD OF THE INVENTION

This invention generally relates to trampolines and more specifically to trampoline systems, which incorporate one or more trampolines and landing areas configured to provide an enhanced entertainment experience while providing safe use for performers.

BACKGROUND OF THE INVENTION

In the past, various types of trampoline arrangements have been used in sports and entertainment formats. Generally, the public enjoys such exhibitions because of the dynamics inherent in using a trampoline and a sense of excitement in seeing what a sportsperson or entertainer (performer) can do in terms of various movements through the air. There is also a sense of excitement because of certain uncertainties on how well the sportsperson or entertainer will land during and at the completion of the performance. While certain physical principles apply in every performance, there is still a great deal of art inherent in each and every performance.

While routines may vary considerably from performer to performer, over a period of time, there is always an interest in new and more exciting routines that may be performed. A performer exerts a considerable amount of physical energy in any performance and requires considerable stamina. At times the performance becomes so demanding that the performer may lose a sense of orientation and land incorrectly. The consequences of a bad landing may be quite drastic and include tearing of tendons and muscles as well as bone breaks.

Some of these safety issues have been addressed in various ways in a number of disclosures. In one such disclosure, Nissen, U.S. Pat. No. 4,045,021 provides a tumbling apparatus in connection with a tumbling apparatus having soft parts. In another disclosure, Rich, U.S. Pat. No. 6,478,718 provides an adjustable ladder used as a safety ladder for mounting and dismounting a trampoline. Other disclosures such as Taylor, U.S. Pat. No. 6,162,061 provide trampoline arrangements used for training purposes in other sports such as skiing.

However, there are no disclosures, which show arrangements for trampolines that are principally directed to entertainment in a theatrical setting. Theatrical performances have additional demands compared to simpler sporting events where trampolines may be used. In particular, the entertainer should provide an extra thrill element while making it appear as though the entertainer has full control of the situation or act. Additionally, such a performer (entertainer) is often at the edge of technological capability with regard to how to use the trampoline and must use significant judgment in the kind of routines, tricks or activities to insure that they are relatively low risk. A professional trampoline performer's income depends on preventing injury while at the same time keeping audiences highly engaged in what is happening on the stage.

SUMMARY OF THE INVENTION

The current disclosure is directed to trampoline systems and assemblies using various props that provide improved visual theatrical exhibitions while providing elements of safety for a performer, such as means for the performer to make a softer landing and regain balance. The various embodiments disclosed herein are meant to be illustrative of the general concept and are not intended to limit any facet of this disclosure.

In accordance with an embodiment of this invention, a trampoline system is disclosed. The trampoline system comprises, in combination, at least one step assembly comprising at least one flight of steps. The step assembly includes one or more sides and at least one landing surface. Furthermore, one or more trampolines may be located peripherally about the one or more sides of the at least one step assembly and the one or more trampolines each have at least one rebound top surface. The trampoline system provides a softer landing and rebalancing opportunity from the at least one step assembly onto the at least one rebound top surface of the one or more trampolines. The at least one step assembly may include at least one top landing surface and at least one bottom landing surface.

In an aspect, the system further comprises a trampoline located on a portion of the at least one top landing surface. In yet another aspect, the system may further comprise four trampolines located on each side of the at least one step assembly. Furthermore, the at least one step assembly may comprise two flights of steps and the at least one step assembly may have a top landing surface and a pair of bottom landing surfaces.

In yet another aspect, a first step assembly of the at least one step assembly may include two flights of steps having a top landing surface and two bottom landing surfaces and a second step assembly comprising a third flight of steps substantially at right angles to the first step assembly. Furthermore, the system may comprise four trampolines located between a pair of step assemblies of the at least one step assembly.

In yet another aspect the system may further comprise a substantially circular step assembly having a top landing surface and surrounded axially by a trampoline. Furthermore, a trampoline may be located on the top landing surface.

In another aspect, the system may have a shaped step assembly including a top landing surface and a suitably dimensioned bottom landing surface according to performance requirements. Furthermore, the shaped step assembly may be substantially semi-circular.

In accordance with another embodiment of this invention, a method of using a trampoline system during a theatrical performance is disclosed. According to the method, the trampoline system is provided and comprises at least one step assembly including at least one flight of steps. The step assembly includes one or more sides and at least one landing surface and one or more trampolines located peripherally about the one or more sides of the at least one step assembly with one or more trampolines each having at least one rebound top surface. In the method, is included the step of jumping from a portion of the step assembly onto a portion of the at least one rebound top surface of the one or more trampolines. Furthermore, is included rebounding onto at least one of a portion of the step assembly or back onto a portion of the at least one rebound top surface of the one or more trampolines.

Moreover, is included continuing to rebound until a firm landing is made on at least one of a portion of the step assembly or a peripheral ground surface surrounding the trampoline system to discontinue rebounding.

The foregoing and other objects, features, and advantages of the invention will be apparent from the following, more detailed description of the various embodiments of the invention, as illustrated in the accompanying drawings and photographs.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DESCRIPTION OF THE INVENTION

Figure 1:
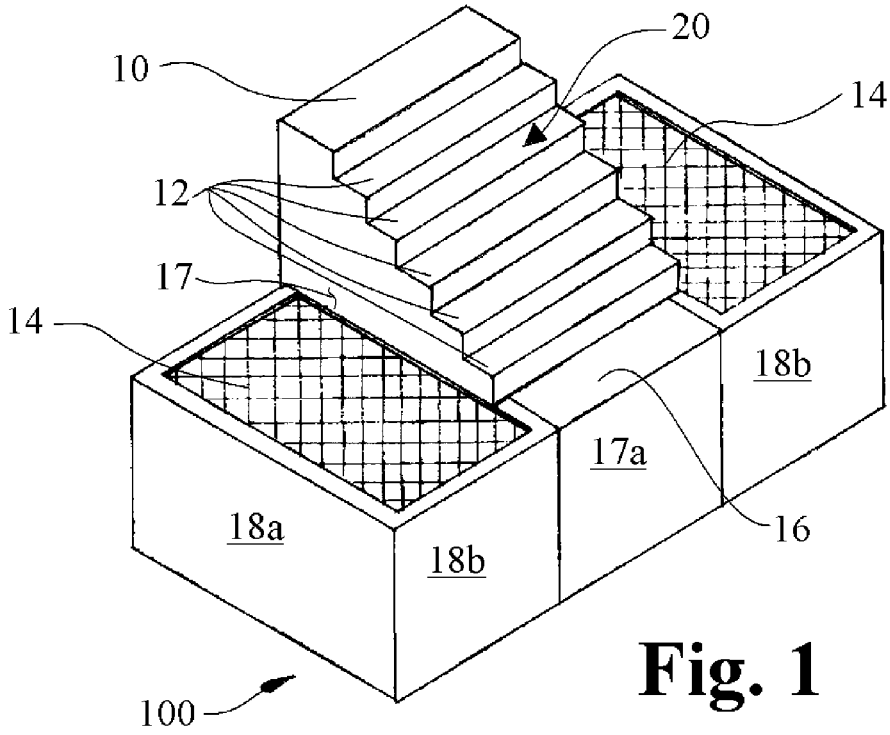
FIG. 1 is a front perspective view of a trampoline system in accordance with an exemplary embodiment of this invention.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature may be called out in another drawing.

The Figures are numbered and annotated so that one skilled in the art of trampoline and prop use and construction, by reference to the Figures, will easily be able to understand the materials and method of construction and will be able to easily assemble the parts to achieve the functionality shown.

In the Summary of the Invention above, the Description of the Invention, and the Claims and Abstract below, and in the accompanying drawings, reference may be made to particular features (including method steps) of the invention. It is to be understood that this disclosure includes most possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

The term "comprises" and grammatical equivalents thereof are used herein to mean that other components, ingredients, steps etc. are optionally present. For example, an article "comprising" (or "which comprises") components A, B and C can consist of (i.e. contain only) components A, B and C, or can contain not only components A, B and C but also one or more other components.

Where reference is made herein to a method comprising two or more defined steps, the defined steps may be implemented in any order or simultaneously (except where the context excludes that possibility). Moreover, the method may include one or more other steps that may be implemented before any of the defined steps, between two of the defined steps, or after all the defined steps (except where the context excludes that possibility).

The term "at least" as denoted herein means one or more, while the term a "plurality" means two or more.

The term "or" is used herein as a conjunction used to link alternatives in a series of alternatives. The term "and/or" is used herein as a conjunction meaning that either or both of two options may be valid.

The term "and" is used herein as a conjunction to indicate an additional thing situation or fact.

When used in the appended claims the term "comprising at least one of A and B" as used herein (depending on the context of the specification) may mean: comprising either one of A or of B (and more), or comprising both of A and of B (and more). As is understood in the patent art, "comprising A" means "A and more", while "comprising B" means "B and more". Thus if A is excluded according to the context of the specification in the phrase "comprising at least one of A and B", then A cannot be part of the "and more" and similarly for B if B is excluded according to the context of the specification.

FIG. 1 depicts an exemplary embodiment of a trampoline system 100. In this disclosure, the term trampoline means "a strong sheet (or tightly woven web), possibly comprising canvas but currently often a synthetic (plastic composite) material that is stretched tightly on a horizontal frame to which the sheet is connected by one or more spring-like devices". Normally, during use, the trampoline sheet would remain substantially parallel to a ground surface upon which the trampoline is placed. Of course, irregularities in the ground surface provide greater uncertainty as to the rebound action that would occur from the trampoline sheet.

According to FIG. 1, the trampoline system 100 comprises one or more trampolines 14 located peripherally about a step assembly 20 comprising one or more steps 12. In this embodiment and in most of the remaining embodiment disclosed herein, the step assembly 20 may further comprise a top landing 10 and a bottom landing 16 unless otherwise indicated. The step assembly 20 may otherwise be referred to as a prop although this is in no way meant as a limitation of this disclosure. Referring to FIG. 1, the step assembly 20 is depicted as a separate structure coupled to one or more trampolines 14 located on a side 17 and an opposite side (not visible in FIG. 1, but substantially the same as the visible side 17 and shown in FIG. 1A) of the step assembly. However, it should be appreciated that the general arrangement of the trampolines and the step assembly 20 does not require that the trampolines be on opposite sides of the step assembly. Further, the step assembly 20 and the one or more trampolines 14 may be configured as a unitary system (that is with no coupling wherein the trampolines may be permanently built into the sides of the step assembly). Of course as a matter of convenience, it would often be desirable to have the step assembly 20 separable from the trampolines 14 so that the trampoline system 100 may be conveniently stored or transported in various theatrical settings. Although not shown in FIG. 1, either side 18*a* or 18*b* of the trampolines 14 may be coupled to one or both sides 17 of the step assembly 20 by various means such a locking nuts, screws, pressure sensitive adhesives, pivots and the like, as is understood in the art. Thus in one non-limiting example, where one or more trampolines 14 is pivotally coupled to sides 17 of the step assembly 20, the trampolines may be folded back against the sides and locked in place against the sides thereby reducing the spatial profile of the trampoline system 100 (see FIG. 3 for an example of a trampoline system wherein the trampolines are angled acutely to the sides 17 of the step assembly).

Figure 1A:
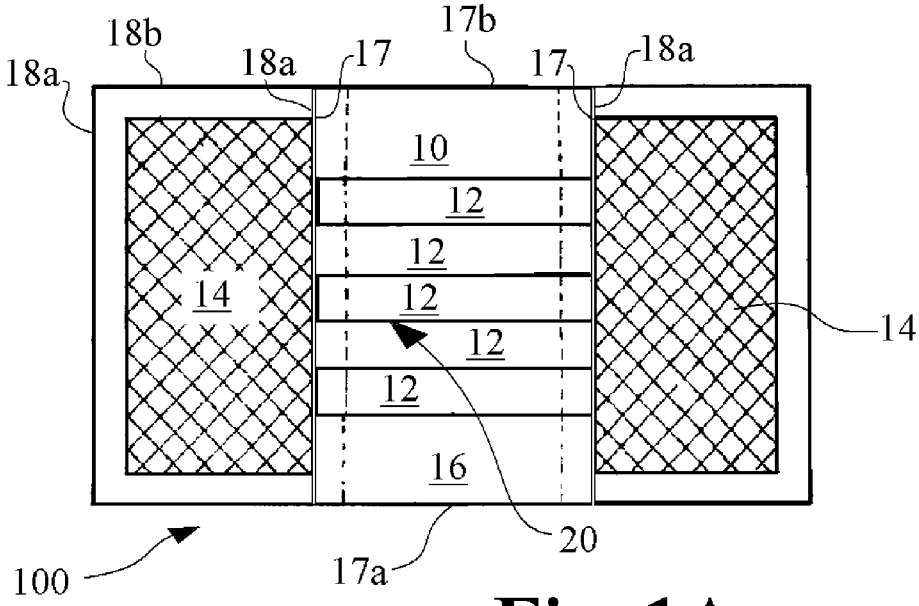
FIG. 1A is a top plan view of the trampoline system of FIG. 1.

Referring now to FIG. 1A, a plan view of the trampoline system 100 provides a bird's eye view of the trampoline system as might be seen by a performer in mid-air during a theatrical performance. It should be clear that the arrangement of the trampolines 14 and the step assembly 20 provides multiple opportunities for a performer to land, regroup and rebalance on the step assembly 20 during various aspects of the theatrical performance. In particular, the top landing 10 and the bottom landing 16 may each be dimensioned or sized to provide a greater landing area so that the performer has an extra measure of safety during the performance. The steps 12 may be equidistant or otherwise dimensioned as a matter of convenience. Naturally, as the performer practices the use of the trampoline system 100, the performer would gain an inherent knowledge of the limitations and placement of the steps 12 and the top landing 10 as well as the bottom landing 16. Such knowledge would provide the performer with the means to accomplish softer landings than would be possible on a planar surface providing only a single level, as well as the means to regain balance better than on a planar surface providing only a single level. Such knowledge would further provide the performer with safety margins and rest periods as might be required during the routine. Moreover, the performer may be able to deliberately create the appearance of danger by appearing to slip off a step 12, and make a miraculous recovery by bouncing off the trampoline or the sides of the step assembly 20. Of course, the step assembly 20 may be decorated in any suitable fashion, which would draw attention to various thematic features of the performance as required. Moreover, the steps 12 may comprise one or more non-slip materials as is understood in the art and remaining materials of construction for the step assembly 100 may comprise padding and other materials, as is understood in the art that would tend to provide a performer with extra measures of protection against injury. It should also be understood that while the step assembly 20 having sides 17, 17*a*, 17*b* and the trampoline sides 18*a,b* appear to be depicted as solid structures, these side structures may be configured in any suitable fashion (that is they may comprise one or more frameworks as is understood in the art). Thus, in the Figures, the sides merely designate the arrangements that may be possible for trampoline systems 100-200 including one or more step assemblies 20 (see FIGS. 1-5 and the description below) of the current disclosure.

Figure 2:
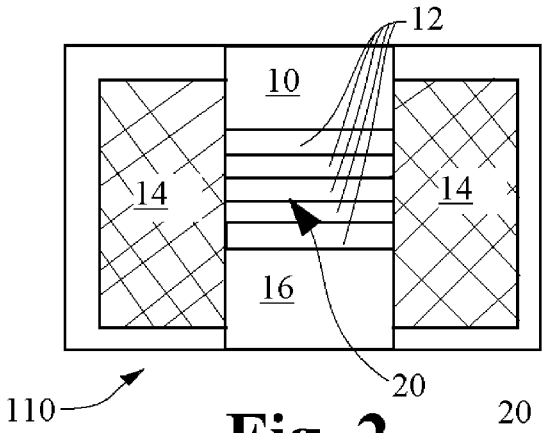
FIGS. 2, 2A, 2B, 2C, 2D are 2E are top plan views of various trampoline systems in accordance with other exemplary embodiments of this invention.

FIGS. 2, 2A-2E depict six different embodiments of trampoline systems 110, 120, 130, 140, 150, 160. It will be observed that the trampoline system 110 of FIG. 2 is the same as the trampoline system 100 of FIG. 1A which has been merely reproduced to provide a frame of reference for the remaining trampoline system embodiments described generally as FIG. 2. In each trampoline system 110-160, one or more trampolines 14 may be arranged about the sides 17, 17*a*, 17*b* (shown in FIGS. 1 and 1A) of one or more step assemblies 20, 20*a*, 20*b* or 20*c*. Of course, it will be appreciated that each arrangement provides a different visual effect to an audience and therefore provides great degrees of theatrical variety. Furthermore, each arrangement provides different degrees of a risk-safety trade-off for the performer. It should be understood that the arrangements of FIGS. 2A-2E are merely illustrative of trampoline systems according to the current disclosure and various modifications may be made by a person skilled in the art.

Figure 2A:
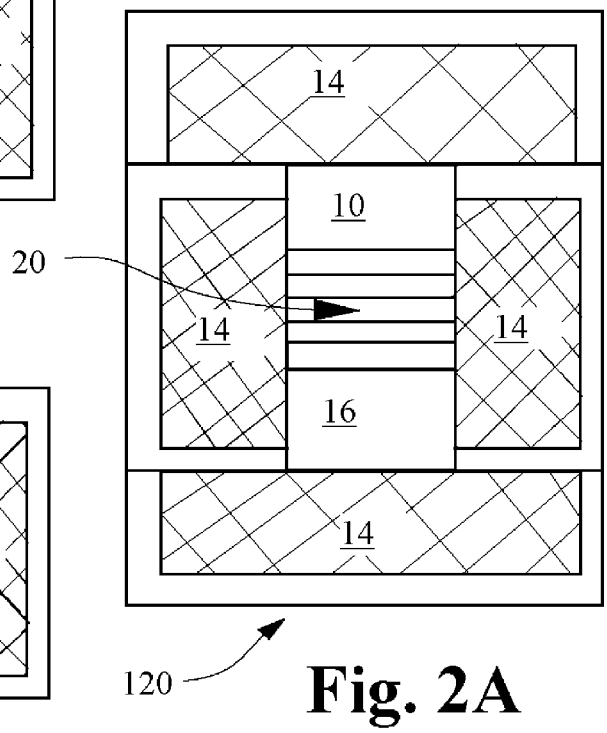

FIG. 2A depicts a trampoline system 120 comprising four trampolines 14 located on each side of a step assembly 20. As depicted, in contrast to trampoline system 110, the top landing 10 of the step assembly 20 now provides a jump-off point to a trampoline located substantially on a rear side 17*b* (see FIG. 1A for reference) of the step assembly 20. Furthermore, the bottom landing 16 or any intermediary steps 12 (see FIG. 1A for reference) of the step assembly 20 may be used as jump-off points to a trampoline 14 located substantially on a front side 17*a* of the step assembly. In other respects, the trampoline system 120 is similar to trampoline system 110 of FIG. 2 (that is a trampoline 14 is located on each of the sides 17 of the step assembly). As depicted in FIG. 2A, the trampolines 14 form a closed assembly, although it will be understood that such an assembly is merely illustrative of a possible four-sided arrangement rather than the two-sided assembly of FIG. 2 about the step assembly 20. In other words, all four trampolines 14 do not need to be joined to one another as shown in FIG. 2A.

Figure 2B:
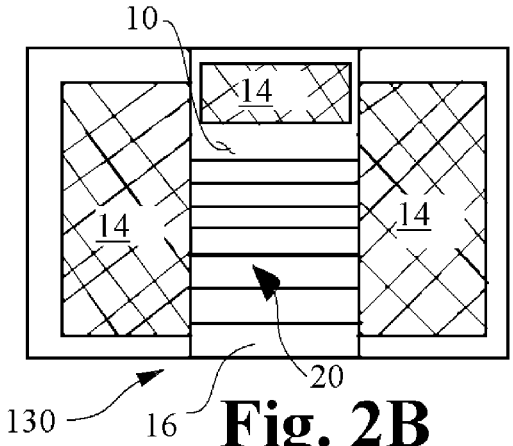

FIG. 2B depicts substantially the same arrangement as shown in FIG. 2. However, in FIG. 2B the trampoline system 130 has an extra trampoline 14 located on a portion of the top landing 10. It will be appreciated that the extra trampoline 14 provides enhanced excitement. It should further be understood that the top landing 10 depicted in FIG. 2B may be sized in any suitable manner to insure safety of a performer. Furthermore, of course the concepts shown in the arrangements of FIG. 2A and FIG. 2B (and other embodiments shown herein) may be combined in any fashion as would be well understood in the art.

Figure 2D:
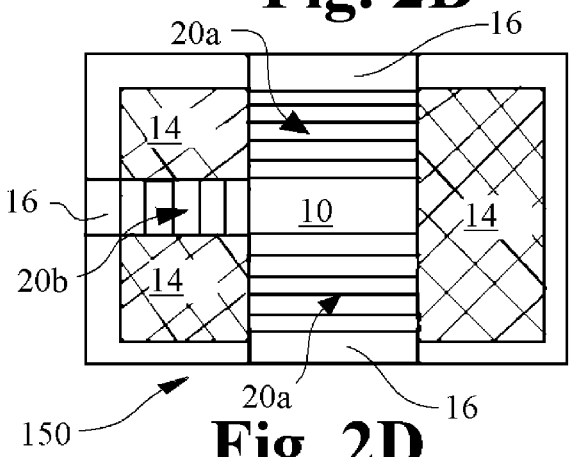
Figure 2C:
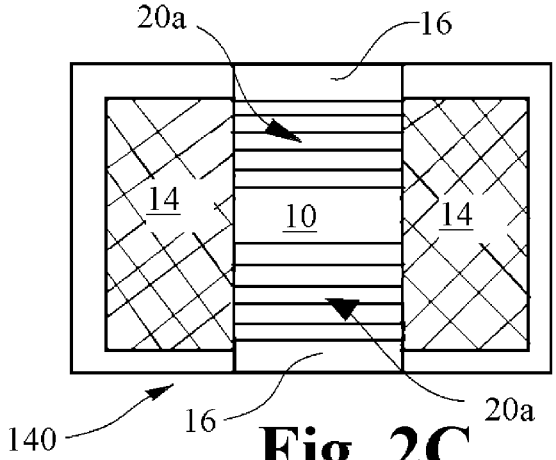

FIG. 2C (with reference to FIGS. 1 and 1A) illustrates that the trampoline system 140 may comprise a pair of trampolines 14 located on sides 17 of a step assembly 20*a*, wherein the step assembly comprises two flights of steps 12 with a top landing 10 and two bottom landings 16.

In yet another embodiment, the trampoline system 150 of FIG. 2D (with reference to FIGS. 1 and 1A) comprises three trampolines 14, wherein the step assembly 20*a* includes two flights of steps 12 with a top landing 10 and two bottom landings 16 (similar to FIG. 2C) and another step assembly 20*b* comprising a third flight of steps 12 substantially at right angles to the step assembly 20*a*. Referring to FIG. 2D, the step assemblies 20*a*, 20*b* are depicted as having a common landing 10 and three separated bottom landings 16.

Figure 2E:
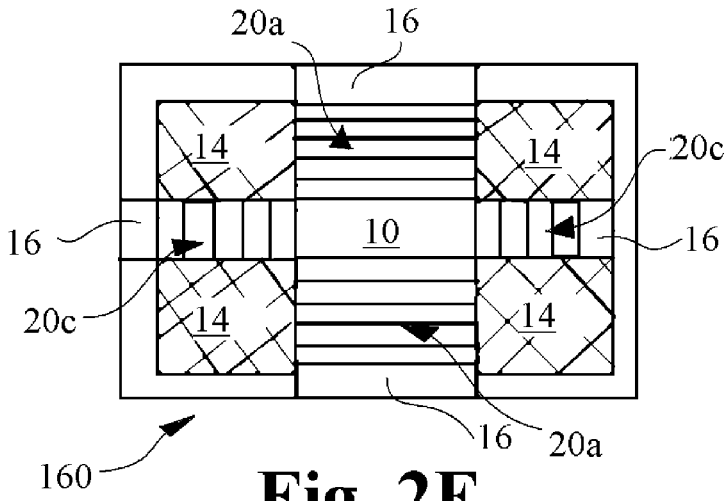

FIG. 2E (with reference to FIGS. 1 and 1A) depicts yet another embodiment of a trampoline system 160. According to FIG. 2E, the trampoline system 160 comprises four trampolines 14 located between a pair of step assemblies 20*a* and 20*c*. The step assemblies 20*a* and 20*c* may be substantially similar because they both comprise two flights of stairs 12 extending from one side of the trampoline system 160 to another side of the trampoline system. The step assemblies 20*a* and 20*c* may have a common top landing 10 and otherwise comprise four separate bottom landings 16 as shown in FIG. 2E. Therefore, the opportunities for routine variations during a trampoline performance is substantially enhanced. Moreover, in a theatrical stage setting, the visibility of various aspects of the trampoline system 160 may be altered because of the semi-pyramidal shape of the trampoline system. The trampoline system 160 may be well suited for a stage of a theater on the round. However, it should be understood that the trampoline systems described herein may further comprise rotational devices (such as wheels) which may permit the entire trampoline system to be slowly rotated in the plane of a ground surface during the performance as an element of enhanced excitement. Of course, with reference to FIGS. 2, 2A-2E described above (and FIGS. 3-5 below), these arrangements of trampolines 14, step assemblies 20*a*, 20*b* and 20*c*, and landings 10, 16 could be altered as required or desired.

Figure 3:
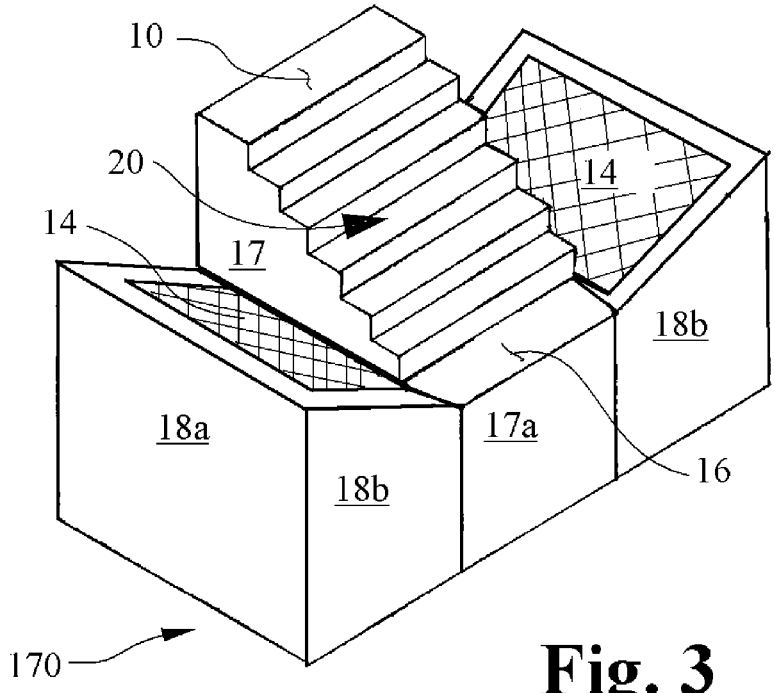
FIG. 3 is a front perspective view of yet another trampoline system wherein several trampolines are angled from a prop rather than being horizontal in accordance with yet another exemplary embodiment of this invention.

FIG. 3 illustrates yet another embodiment of a trampoline system 170. As depicted, the top surfaces of the trampolines 14 are elevated in comparison to those of the trampoline system 100. FIG. 3 somewhat exaggerates the angles between the top surfaces of the trampoline and the sides 17 of the step assembly 20. It is contemplated that the acute angle between the top surface of each trampoline and the side 17 of the step assembly 20 may range between about 90 degrees and about 50 degrees. It may be possible that the angle may be a slightly obtuse angle. However, it will be appreciated that a severe obtuse angle between the top surface of the trampoline 14 and the side of the step assembly 20 would create significant physical challenges for a performer who would tend to be rebounded away from the step assembly. In this context, it will be further appreciated that a second step assembly 20' (not shown) on another side of the trampoline 14 could be a landing region if the angle between the top surface of the trampoline and a side 17 of the first step assembly 20 was obtuse. In that case, the angle between the top surface of the trampoline 14 and another side 17' (not shown) of the second step assembly 20' (not shown) would be acute.

Figure 4:
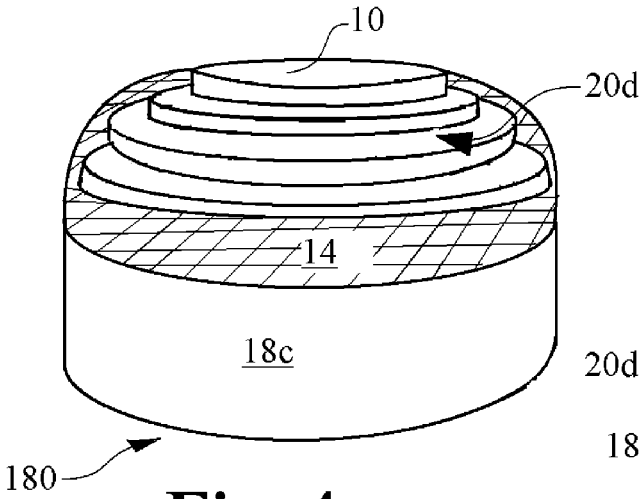
FIG. 4 is a front perspective view of another trampoline system in accordance with yet another exemplary embodiment of this invention.

FIG. 4 is a front perspective view of a trampoline system 180 comprising a substantially circular step assembly 20*d* having a top landing 10 and surrounded axially by a trampoline 14. As depicted in FIG. 4, the trampoline system 180 would be substantially cylindrical in shape.

Figure 4A:
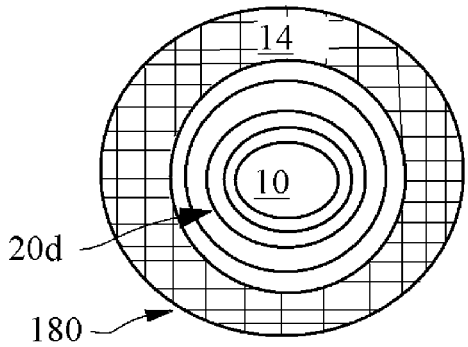
FIG. 4A is a top plan view of the trampoline system of FIG. 4.

The features of this trampoline system 180 may be better envisioned by reference to FIG. 4A which depicts a top plan view of the trampoline system. Of course, another step assembly such as that shown in any of FIGS. 2, 2A-2E may be configured in the trampoline system 180, wherein the top landing 10 may be common to all the step assemblies. Furthermore, the step assembly 20*d* may further comprise a bottom landing 16 (not labeled).

Figure 4B:
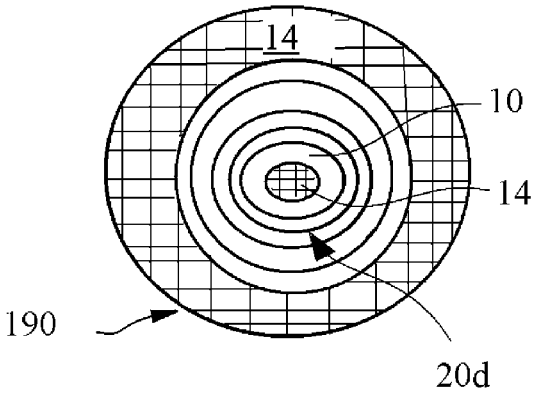
FIG. 4B is a top plan view of another trampoline system such as that shown in FIG. 4 with an additional trampoline depicted on the top landing of the system.

FIG. 4B illustrates yet another embodiment of a trampoline system 190 which comprise the same elements as the trampoline system 180, but further includes a trampoline 14 located on a portion of the top landing 10 (this is similar to the trampoline system 130 of FIG. 2B described above). It should be appreciated that without limiting the disclosure, the circular appearance of trampoline systems 180, 190 may be altered to be substantially any closed shape such as an oval or egg shape or may have inclusions to provide U-shaped, S-shaped or any other shape desired).

Figure 5:
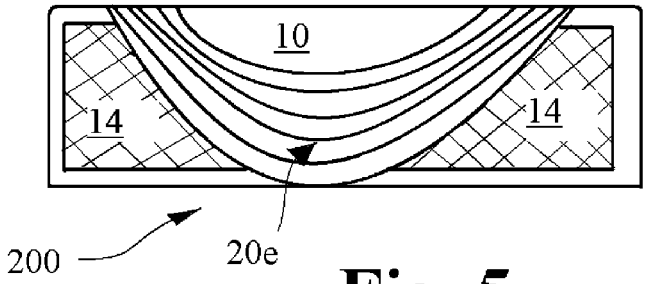
FIG. 5 is a top plan view of yet another trampoline system according to another exemplary embodiment of this invention.

FIG. 5 illustrates yet another embodiment of a trampoline system 200 wherein combinations of the trampoline systems 100 and 180 features disclosed in FIG. 1 and FIG. 4 are shown. Specifically, the trampoline system 200 comprises a shaped step assembly 20*e* which may be somewhat semicircular and includes a top landing 10. Furthermore, the step assembly 20*e* may include a bottom landing 16 (not labeled). Moreover, without limiting the disclosure, the step assembly 20*e* (and for that matter any other step assembly described herein) may include intermediate landings (not shown) which are all dimensioned according to the needs of a performer. The trampoline system 200 further comprises one or more trampolines 14 coupled to one or more sides of the step assembly 20*e*.

While the invention has been particularly shown and described with reference to preferred embodiments thereof, it will be understood by those skilled in the art that the foregoing and other changes in form and details may be made therein without departing from the spirit and scope of the invention. The scope of the present invention is not intended to be limited by the specific examples set out herein.

What is claimed is:

1. A trampoline system comprising, in combination:

at least one step assembly comprising at least one flight of steps, said flight of steps including at least three steps, said step assembly including one or more sides and at least one landing surface, said landing surface comprising a flat portion of sufficient size to allow a performer to land thereon;

multiple trampolines located peripherally about said one or more sides of said at least one step assembly, each of said multiple trampolines having at least one rebound top surface, and with the angle between each of said at least one rebound top surface and at least one of said landing surfaces being between 90 and 180 degrees to allow repeated rebounding between said at least one rebound top surface and said at least one step assembly;

wherein said at least one landing surface is positioned and configured to receive multiple landings from a performer rebounding from the at least one rebound top surface of one of the multiple trampolines.

2. The system of claim 1, wherein said at least one step assembly includes at least one top landing surface configured to receive the impact of the performer's body landing from one of said multiple trampolines and at least one bottom landing surface configured to receive the impact of the performer's body landing from one of said multiple trampolines.

3. The system of claim 2 wherein said multiple trampolines comprise a first trampoline located on a portion of said at least one top landing surface.

4. A trampoline system of comprising, in combination:

at least one step assembly comprising at least one flight of steps, said flight of steps including at least three steps, said step assembly including one or more sides and at least one landing surface;

four trampolines located on each side of said at least one step assembly, each of said four trampolines having at least one rebound top surface;

wherein said trampoline system is configured to allow multiple landings onto said at least one step assembly and multiple rebounds from said at least one rebound top surface of each of said four trampolines; and wherein said at least one step assembly includes at least one top landing surface configured to receive the impact of a human body landing from one of said one or more trampolines and at least one bottom landing surface configured to receive the impact of a human body landing from one of said one or more trampolines.

5. The system of claim 2, wherein said at least one step assembly comprises two flights of steps of at least three steps each and said at least one landing surface comprises a top landing surface and a pair of bottom landing surfaces.

6. The system of claim 2, wherein said at least one step assembly comprises a first step assembly including two flights of steps of at least three steps each having a top landing surface and two bottom landing surfaces and comprises a second step assembly comprising a third flight of steps of at least three steps substantially at right angles to said first step assembly.

7. The system of claim 2, wherein said multiple trampolines comprise four trampolines located between a pair of step assemblies of said at least one step assembly.

8. The system of claim 1 further comprising a substantially circular step assembly having a top landing surface and said circular step assembly surrounded axially by a first trampoline of said multiple trampolines.

9. The system of claim 8 wherein said multiple trampolines further comprise a second trampoline located on said top landing surface.

10. The system of claim 1 wherein said at least one step assembly is shaped as a semi-circle that includes both a top landing surface and a bottom landing surface.

11. The system of claim 1, wherein said at least one step assembly includes a first step assembly and a second step assembly each of which comprises at least three steps, with said first step assembly positioned at substantially a right angle to said second step assembly.

* * * * *